US009662777B2

(12) United States Patent
Pomeroy et al.

(10) Patent No.: US 9,662,777 B2
(45) Date of Patent: May 30, 2017

(54) PNEUMATIC FASTENER DRIVER

(71) Applicant: Techtronic Power Tools Technology Limited, Tortola (VG)

(72) Inventors: Edward A. Pomeroy, Piedmont, SC (US); John Schnell, Anderson, SC (US)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 801 days.

(21) Appl. No.: 13/973,576

(22) Filed: Aug. 22, 2013

(65) Prior Publication Data

US 2015/0053736 A1 Feb. 26, 2015

(51) Int. Cl.
*B25C 1/04* (2006.01)
*B25C 5/13* (2006.01)

(52) U.S. Cl.
CPC ..... *B25C 1/041* (2013.01); *B25C 1/047* (2013.01); *B25C 5/13* (2013.01)

(58) Field of Classification Search
None
See application file for complete search history.

(56) References Cited

U.S. PATENT DOCUMENTS 309,335 A 12/1884 Condict, Jr.
309,493 A 12/1884 Rose
386,302 A 7/1888 Donovan et al.
454,498 A 6/1891 Robinson
973,668 A 10/1910 Kellogg
1,688,903 A 10/1928 Thompson
2,983,922 A * 5/1961 Juilfs ..... B25C 1/041 227/130
3,086,207 A * 4/1963 Lingle ..... B25C 1/005 227/123
3,205,787 A * 9/1965 Volkmann ..... B25C 1/047 227/130
3,288,339 A * 11/1966 Bade ..... B25C 1/041 227/130
3,407,709 A * 10/1968 Bade ..... B25C 1/047 227/113
3,498,517 A * 3/1970 Novak ..... B25C 1/041 227/130
3,584,776 A * 6/1971 Bolte ..... B25C 1/047 227/130

(Continued)

FOREIGN PATENT DOCUMENTS

JP WO 2011010634 A1 * 1/2011 ..... B25C 1/04
WO 9625273 8/1996

(Continued)

*Primary Examiner* — Hemant M Desai
*Assistant Examiner* — Tanzim Imam
(74) *Attorney, Agent, or Firm* — Michael Best & Friedrich LLP

(57) ABSTRACT

The invention provides, in one aspect, a pneumatic fastener driver including a cylinder and a piston positioned within the cylinder. The piston is moveable between a top-dead-center position and a bottom-dead-center position. The driver also includes a magnetic latch emitting a magnetic field that magnetically attracts the piston and is capable of holding the piston in the top-dead-center position with a magnetic force. The magnetic latch is adjustable to vary the magnetic force acting on the piston for driving fasteners into a workpiece at different depths.

16 Claims, 7 Drawing Sheets

(56) References Cited

U.S. PATENT DOCUMENTS 3,788,195 A * 1/1974 Lange ..... B25C 1/041 227/130
3,858,781 A 1/1975 Obergfell et al.
4,294,391 A 10/1981 Obergfell
4,344,555 A * 8/1982 Wolfberg ..... B25C 1/043 227/130
4,401,251 A * 8/1983 Nikolich ..... B25C 1/047 227/130
4,403,722 A 9/1983 Nikolich
4,483,474 A 11/1984 Nikolich
4,566,619 A 1/1986 Kleinholz
4,593,845 A 6/1986 Andersson et al.
4,688,710 A 8/1987 Massari, Jr. et al.
4,709,843 A * 12/1987 Wagenknecht ..... B25B 31/00 227/156
4,890,987 A 1/1990 Sato et al.
4,936,192 A 6/1990 Johnsson et al.
5,004,140 A 4/1991 Fushiya et al.
5,018,657 A 5/1991 Pedlick et al.
5,020,712 A 6/1991 Monacelli
5,096,025 A 3/1992 Herberg
5,188,016 A 2/1993 Tung
5,199,627 A 4/1993 Christensen
5,335,587 A 8/1994 Stoll
5,346,024 A 9/1994 Geiger et al.
5,487,499 A 1/1996 Sorrentino et al.
5,605,268 A 2/1997 Hayashi et al.
5,647,525 A 7/1997 Ishizawa
5,720,423 A 2/1998 Kondo et al.
5,732,870 A 3/1998 Moorman et al.
5,772,096 A 6/1998 Osuka et al.
5,785,227 A 7/1998 Akiba
5,878,936 A 3/1999 Adachi et al.
5,911,351 A 6/1999 White
5,996,874 A 12/1999 Fakushima et al.
6,126,410 A 10/2000 Kung et al.
6,145,727 A 11/2000 Mukoyama et al.
6,161,628 A 12/2000 Liu
6,371,348 B1 4/2002 Canlas et al.
6,382,492 B1 5/2002 Moorman et al.
6,422,447 B1 7/2002 White et al.
6,431,429 B1 8/2002 Canlas et al.
6,488,195 B2 12/2002 White et al.
6,499,643 B1 12/2002 Hewitt
6,604,666 B1 8/2003 Pedicini et al.
6,626,081 B2 9/2003 Ho et al.
6,672,498 B2 1/2004 White et al.
6,691,907 B1 2/2004 Chang
6,705,503 B1 3/2004 Pedicini et al.
6,766,935 B2 7/2004 Pedicini et al.
6,769,593 B2 8/2004 Pedicini et al.
6,857,422 B2 2/2005 Pedicini et al.
6,883,696 B1 4/2005 Steinbrunner et al.
7,152,774 B2 12/2006 Chen
7,159,291 B2 1/2007 Ohuchi
7,194,988 B2 3/2007 Ohmori et al.
7,204,402 B2 4/2007 Burke et al.
7,225,959 B2 6/2007 Patton et al.
7,278,561 B2 10/2007 Schnell et al.
7,328,494 B2 2/2008 Kitagawa et al.
7,329,123 B2 2/2008 Tanaka et al.
7,387,092 B2 6/2008 Nishikawa et al.
7,419,079 B2 9/2008 Chen et al.
7,445,139 B2 11/2008 Okouchi
7,451,903 B2 * 11/2008 Aihara ..... B25C 1/042 227/130
7,484,481 B2 2/2009 Fujisawa et al.
7,487,898 B2 2/2009 Moeller et al.
7,494,036 B2 2/2009 Shima et al.
7,500,587 B2 3/2009 Akiba et al.
7,513,402 B2 4/2009 Miyashita et al.
7,568,602 B2 8/2009 Turk
7,673,779 B2 3/2010 Moeller et al.
7,703,648 B2 4/2010 Tamura et al.
7,703,651 B2 4/2010 Yamamoto et al.
7,712,462 B2 5/2010 Pedicini et al.
7,793,811 B1 9/2010 Pedicini et al.
7,931,455 B2 4/2011 Tabassi
8,079,504 B1 * 12/2011 Pedicini ..... B25C 1/04 227/130
2004/0232194 A1 11/2004 Pedicini et al.
2006/0255085 A1 11/2006 Wen
2007/0045377 A1 * 3/2007 Towfighi ..... B25C 1/06 227/130
2007/0175945 A1 8/2007 Chen et al.
2008/0060734 A1 3/2008 Stehle
2008/0073404 A1 3/2008 Hylton
2008/0190988 A1 8/2008 Pedicini et al.
2008/0217372 A1 9/2008 Webb
2008/0223900 A1 9/2008 Tanji
2009/0032563 A1 2/2009 Yokochi
2009/0057368 A1 3/2009 Lin
2009/0071998 A1 3/2009 Nakano et al.
2009/0166392 A1 7/2009 Dion et al.
2009/0272782 A1 11/2009 Johnson et al.
2010/0072248 A1 3/2010 Lai et al.
2010/0092588 A1 4/2010 Tabassi
2010/0176175 A1 7/2010 Tamura et al.
2010/0193561 A1 8/2010 Tanaka
2010/0305624 A1 12/2010 Lozier et al.
2012/0286014 A1 * 11/2012 Pedicini et al. ..... B25C 1/06 227/130
2014/0054350 A1 * 2/2014 Pedicini ..... B25C 5/15 227/8

FOREIGN PATENT DOCUMENTS

WO 2008029901 3/2008
WO 2010043178 4/2010
WO 2010099024 9/2010
WO 2011010511 1/2011
WO 2011010512 1/2011
WO 2011010634 1/2011

* cited by examiner

PNEUMATIC FASTENER DRIVER

FIELD OF THE INVENTION

The present invention relates to a pneumatic fastener driver.

BACKGROUND OF THE INVENTION

There are various fastener drivers used to drive fasteners (e.g., nails, tacks, staples, etc.) into a workpiece known in the art. These fastener drivers operate utilizing various means (e.g., compressed air generated by an air compressor, electrical energy, flywheel mechanisms) known in the art, but often these designs are met with power, size, and cost constraints.

SUMMARY OF THE INVENTION

The invention provides, in one aspect, a pneumatic fastener driver including a cylinder and a piston positioned within the cylinder. The piston is moveable between a top-dead-center position and a bottom-dead-center position. The driver also includes a magnetic latch emitting a magnetic field that magnetically attracts the piston and is capable of holding the piston in the top-dead-center position with a magnetic force. The magnetic latch is adjustable to vary the magnetic force acting on the piston for driving fasteners into a workpiece at different depths.

The invention provides, in another aspect, a pneumatic fastener driver including a housing, a cylinder positioned within the housing, a piston positioned within the cylinder that is movable between a top-dead-center position and a bottom-dead-center position, and a cylinder head integrally formed at a first end of the cylinder as a single component.

The invention provides, in yet another aspect, a pneumatic fastener driver including a first cylinder, a first piston positioned within the first cylinder, a second cylinder positioned within the first cylinder, a second piston positioned within the second cylinder, and means for positioning the second cylinder relative to the first cylinder.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
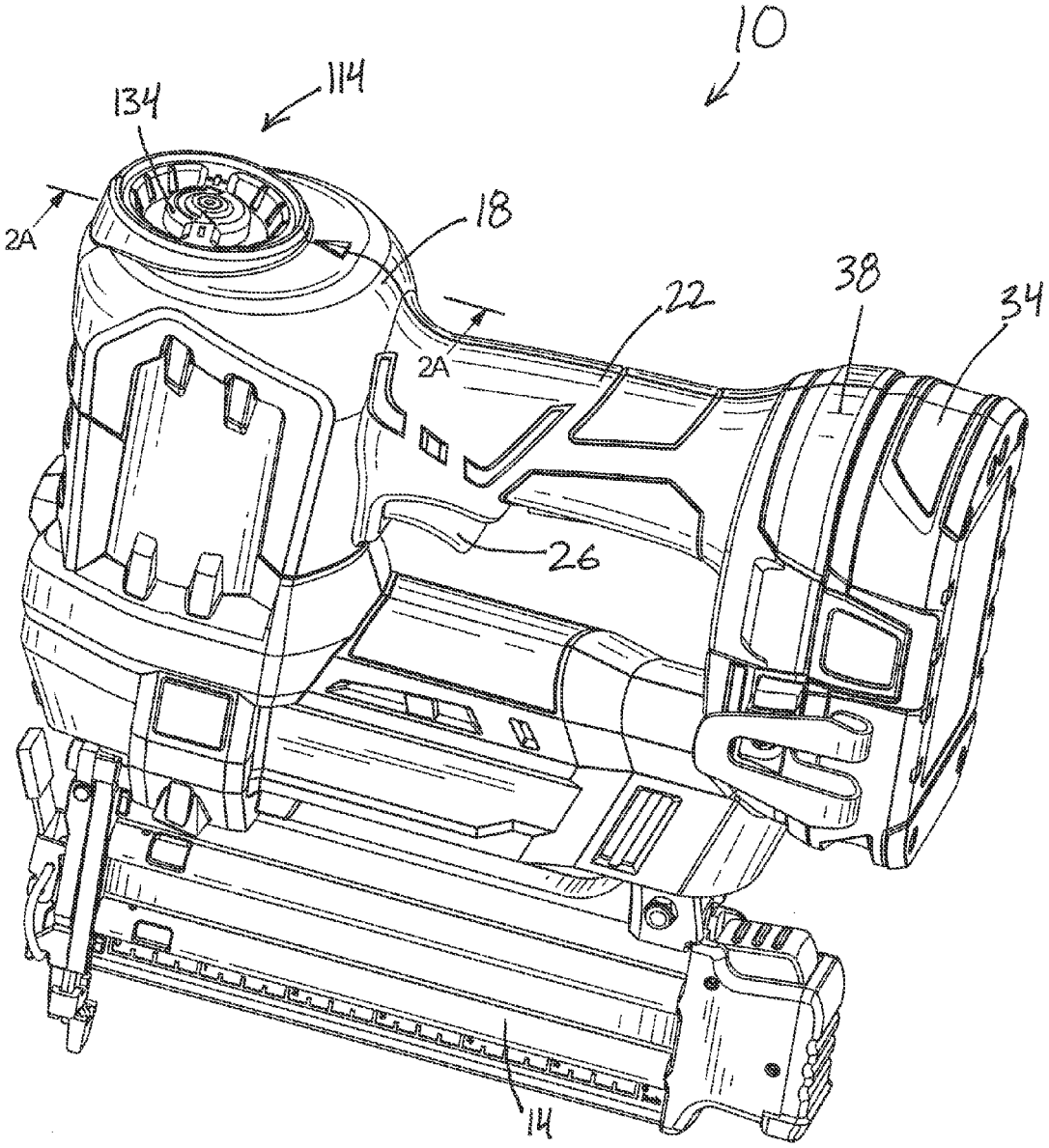
FIG. 1 is a perspective view of a pneumatic fastener driver in accordance with an embodiment of the invention.
Figure 2A:
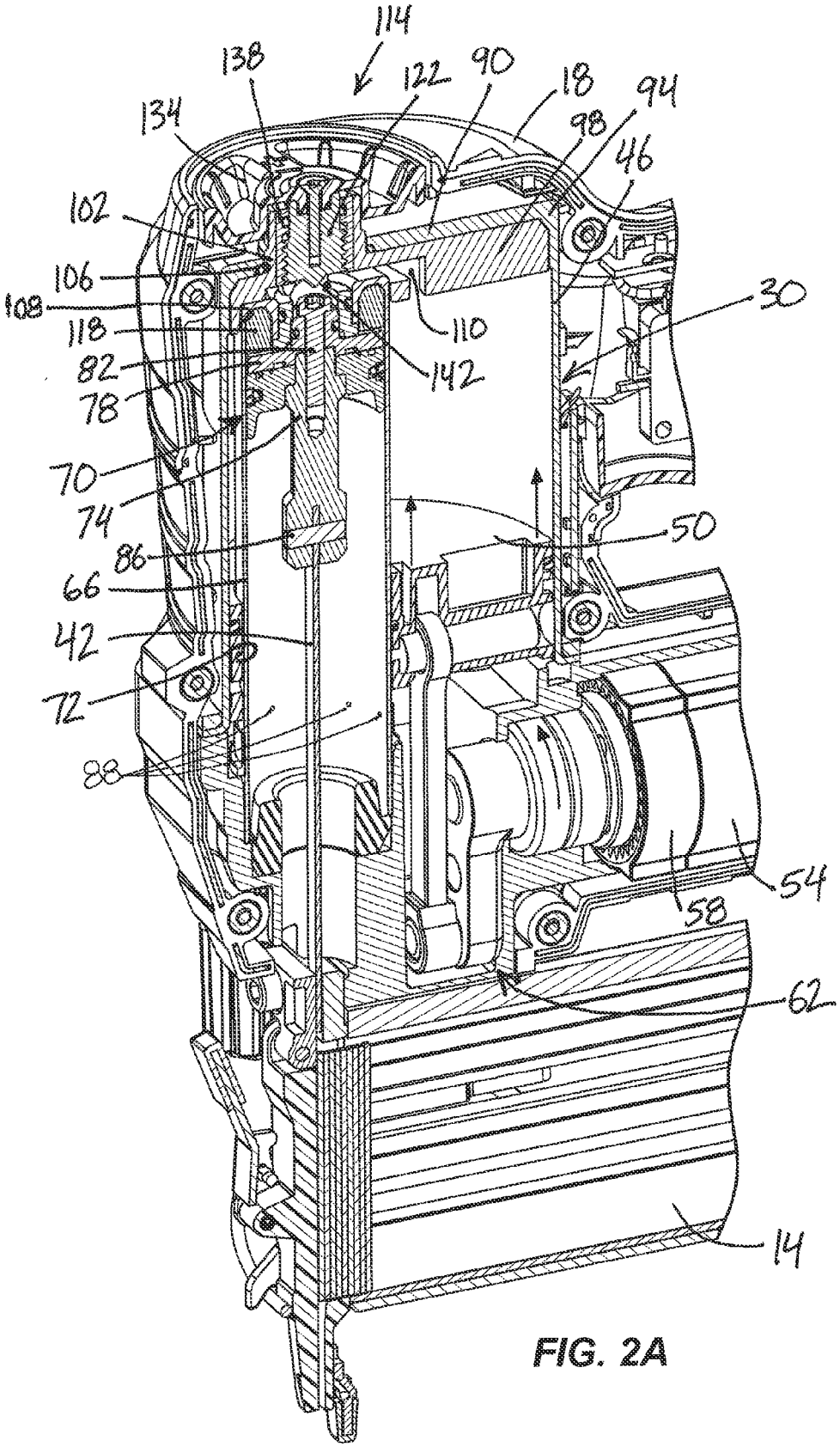
FIG. 2A is a partial cross-sectional view of the pneumatic fastener driver of FIG. 1 taken along line 2A-2A in FIG. 1.

With reference to FIG. 1, a pneumatic fastener driver 10 is operable to drive fasteners (e.g., nails, tacks, staples, etc.) held within a magazine 14 into a workpiece. The pneumatic fastener driver 10 includes an outer housing 18 with a handle portion 22, and a user-actuated trigger 26 mounted on the handle portion 22. The pneumatic fastener driver 10 does not require an external source of air pressure, but rather includes an on-board air compressor 30 (FIG. 2A). The on-board air compressor 30 is powered by a power source (e.g., a battery pack 34), coupled to a battery attachment portion 38 of the outer housing 18.

Figure 2B:
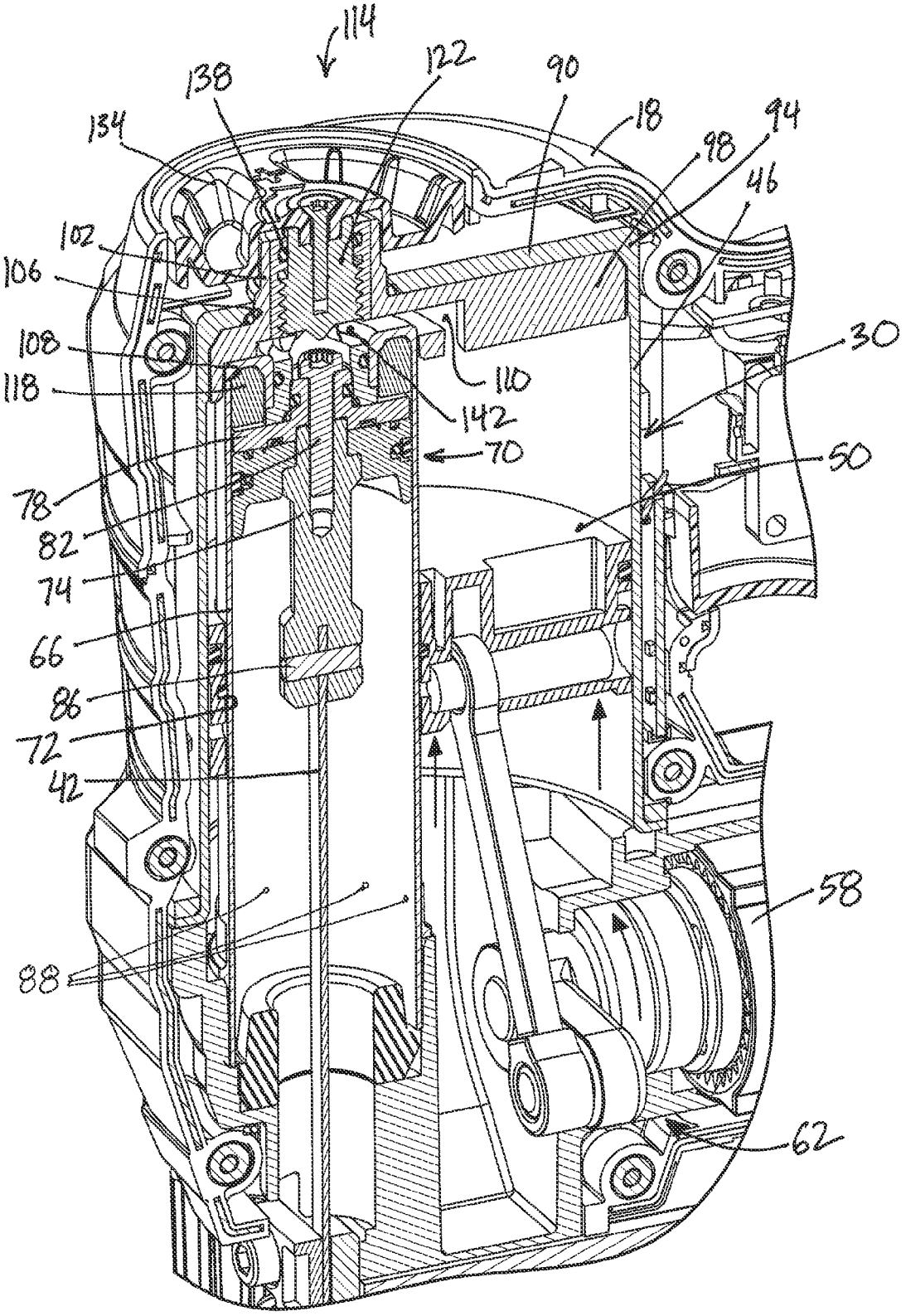
FIG. 2B is an enlarged, partial cross-sectional view of the pneumatic fastener driver of FIG. 2A illustrating an upward stroke of a compression piston.
Figure 2C:
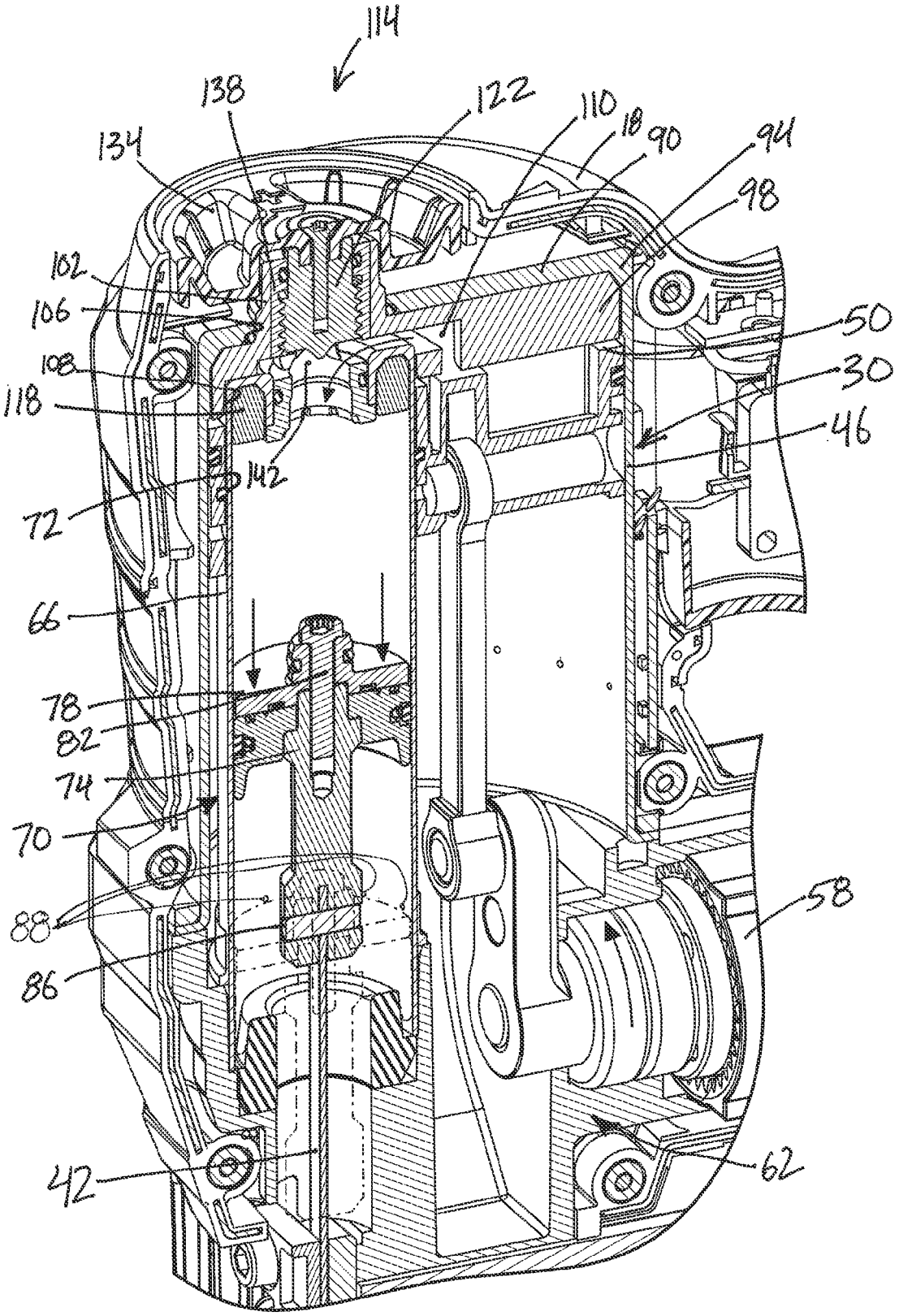
FIG. 2C is an enlarged, partial cross-sectional view of the pneumatic fastener driver of FIG. 2A illustrating a downward stroke of a driver piston.

With reference to FIGS. 2A-2D, the pneumatic fastener driver 10 includes a drive blade 42 actuated by the on-board air compressor 30 to drive the fasteners into a workpiece. The compressor 30 includes a compressor cylinder 46 and a piston 50 in the compressor cylinder 46 driven in a reciprocating manner by a motor 54, a transmission 58, and a crank arm assembly 62. The pneumatic fastener driver 10 also includes a drive cylinder 66 in fluid communication with the compressor cylinder 46 and a drive piston 70 slidably disposed in the drive cylinder 66. As shown in FIG. 2A, the smaller drive cylinder 66 is located inside the larger compressor cylinder 46 for a cylinder-in-a-cylinder configuration. The compressor piston 50 includes a bore 72 through which the drive cylinder 66 extends. The drive piston 70 includes a body 74 and a ferromagnetic cap 78 is secured to the body 74 by a threaded fastener 82. The drive blade 42 is attached to the main body 74 of the drive piston 70 by a pin 86 interference-fit to the main body 74. The drive piston 70 is movable between a top-dead-center position (FIGS. 2A and 2B) and a bottom-dead-center position (FIG. 2C, shown in phantom). The drive cylinder 66 includes a plurality of one-way check valves 88 formed therein to vent excess pressure in the drive cylinder 66 when the drive piston 70 reaches the bottom-dead-center position. Specifically, the check valves 88 are configured as flapper valves that equalize the pressure within the drive cylinder 66 above the drive piston 70 and the pressure within the compressor cylinder 46 below the compressor piston 50 when the valves 88 are uncovered upon the drive piston 70 reaching the bottom-dead-center position. This ensures that there is no excess pressure above the drive piston 70 that would otherwise inhibit the drive piton 70 from being refracted to the top-dead-center position as described in detail below. Similarly, the compressor piston 50 is moveable between a top-dead-center position (FIG. 2C) and a bottom-dead-center position (FIG. 2A).

With continued reference to FIG. 2A, the compressor cylinder 46 includes an integral head 90 formed at a top end 94 of the cylinder 46 (i.e., the head 90 and the cylinder 46 are formed as a single component). The integral compressor cylinder 46 and cylinder head 90 may be manufactured by, for example, a deep-drawing process or an impact extrusion process. The drive cylinder 66 may also be formed using either of the above-mentioned processes with an integral cylinder head.

An end cap 98 is positioned within the compressor cylinder 46 adjacent the top end 94 such that a stem portion 102 of the end cap 98 extends through an opening 106 formed in the cylinder head 90. A combination of the opening 106 in the cylinder head 90 and the stem portion 102 of the end cap 98 provides a means to position and align the drive cylinder 66 within the compressor cylinder 46. In addition, a cylindrical recess 108 is formed in the end cap 98 to receive and position the drive cylinder 66 within the compressor cylinder 46. Accordingly, the cylindrical recess 108 in the end cap 98 can further be considered as a feature of the positioning means described above. Alternatively, a boss or any other alignment feature formed on the cylinder head 90 of the compressor cylinder 46 could facilitate positioning and alignment of the drive cylinder 66 within the compressor cylinder 46. The end cap 98 further includes vents 110, only one of which is shown in FIGS. 2A-3B, to enable fluid communication between the compressor cylinder 46 and the drive cylinder 66. Likewise, the cylindrical recess 108 fluidly communicates the compressor cylinder 66 and the drive cylinder 66.

Figure 3A:
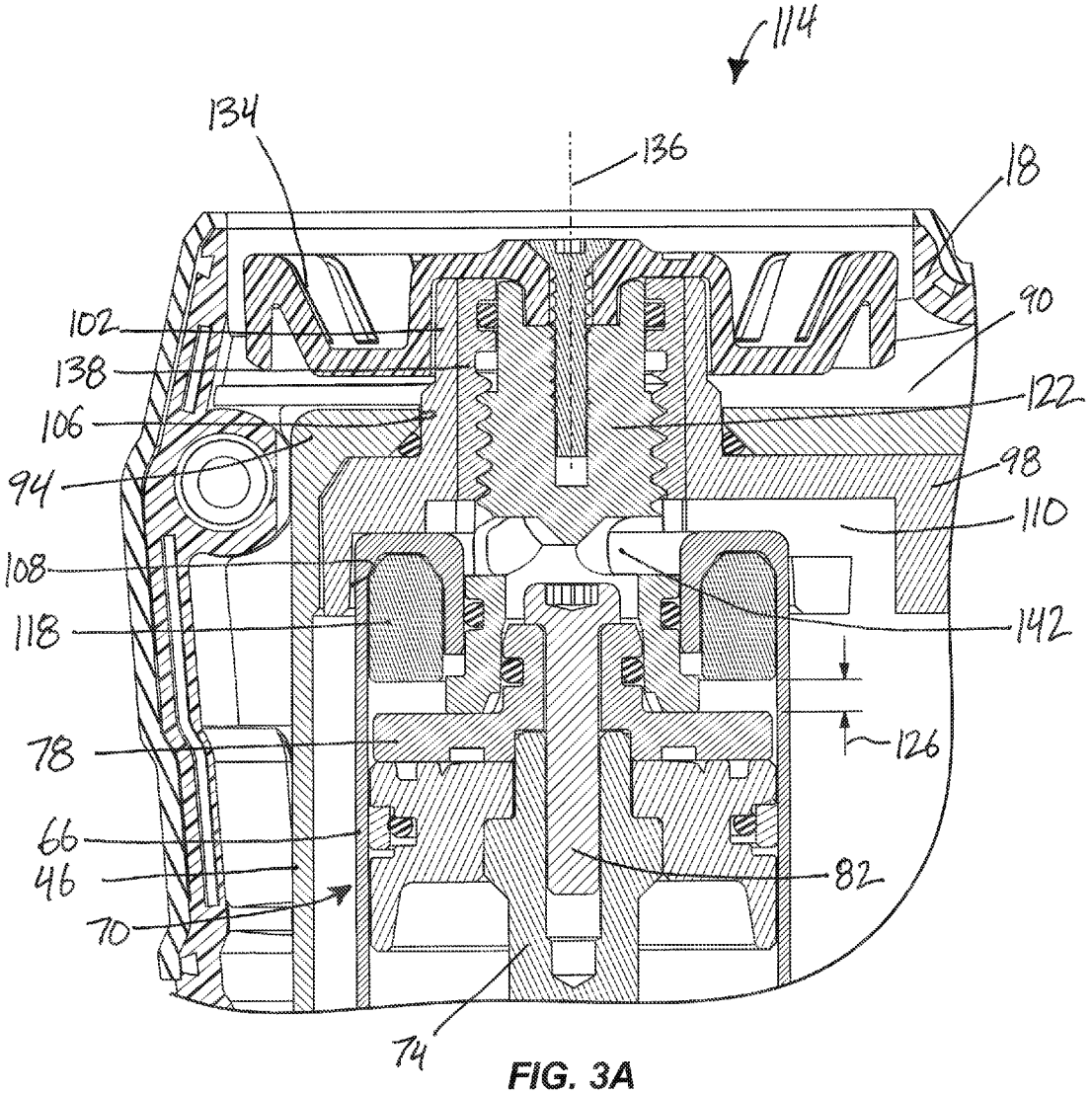
FIG. 3A is an enlarged, cross-sectional view of the pneumatic fastener driver of FIG. 2A illustrating a magnetic latch in a first position.
Figure 3B:
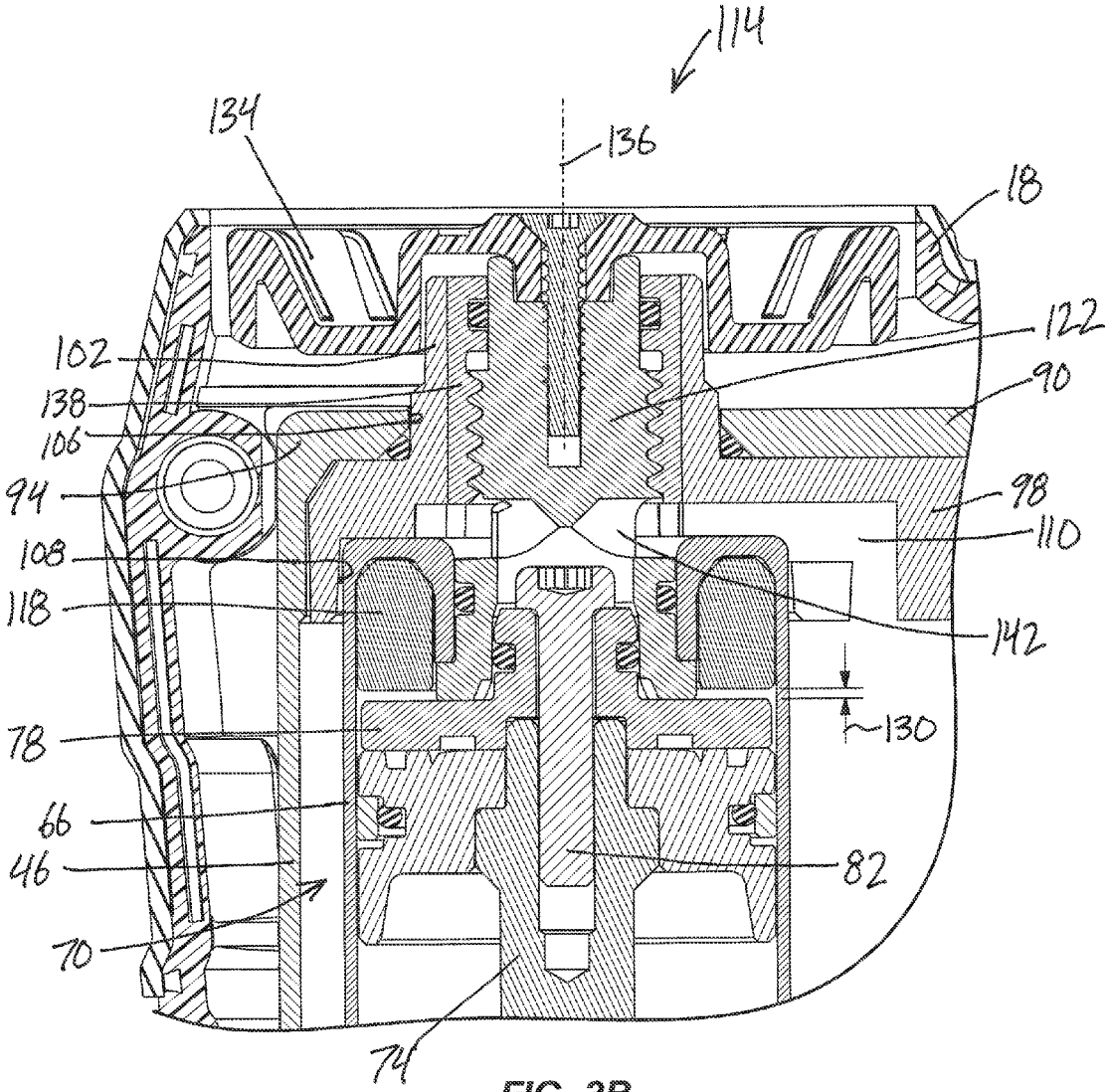
FIG. 3B is an enlarged, cross-sectional view of the pneumatic fastener driver of FIG. 2A illustrating the magnetic latch in a second position.

With reference to FIGS. 3A and 3B, the pneumatic fastener driver 10 further includes a magnetic latch 114 capable of holding the drive piston 70 in the top-dead-center position with a magnetic force. The latch 114 includes an annular magnet 118 positioned near the top of the drive cylinder 66. The annular magnet 118 emits a magnetic field that magnetically attracts the ferromagnetic cap 78, which is also a part of the magnetic latch 114. Alternatively, the magnetic latch 114 could include a ferromagnetic portion positioned near the top of the drive cylinder 66 and a magnet secured to the drive piston 70. The magnetic latch 114 also includes a plunger 122 movable between a first position (FIG. 3A) in which a first gap 126 is created between the ferromagnetic cap 78 of the drive piston 70 and the magnet 118 resulting in a first magnetic force acting on the drive piston 70, and a second position (FIG. 3B) in which a second gap 130 smaller than the first gap 126 is created between the ferromagnetic cap 78 of the drive piston 70 and the magnet 118 resulting in a second magnetic force acting on the drive piston 70 larger than the first magnetic force. In the illustrated embodiment of the driver 10, an internally threaded collar 138 is affixed (e.g., via an interference fit or insert-molding process, etc.) within the stem portion 102 of the end cap 98 and the plunger 122 includes external threads engaged with the internal threads of the collar 138. Due to the pitch of the engaged threads of the plunger 122 and collar 138, rotation of the plunger 122 with respect to the threaded collar 138 causes the plunger 122 to translate (i.e., move along a central axis 136) between the first and second positions. Although the threaded collar 138 and the end cap 98 are separate components in the illustrated embodiment of the driver 10, the threaded collar 138 may alternatively be integrally formed as a single piece with the end cap 98.

The magnetic latch 114 further includes an actuator 134 accessible from the top of the outer housing 18 for moving the plunger 122 between the first and second positions. Particularly, rotation of the actuator 134 about the central axis 136 translates the plunger 122 relative to the threaded collar 138, as described in detail above, moving the plunger 122 between the first and second positions. The plunger 122 includes vents 142 exposed or open to the vents 110 formed in the end cap 98 to place the drive cylinder 66 in fluid communication with the compressor cylinder 46.

At the beginning of a fastener driving operation as shown in FIG. 2A, the magnetic latch 114 maintains the drive piston 70 in the top-dead-center position, while the compressor piston 50 is located in the bottom-dead-center position. When the user of the driver 10 depresses the trigger 26, the compressor piston 50 is driven upward and toward the top end 94 of the compressor cylinder 46 by the motor 54 and crank arm assembly 62 (FIG. 2B). As the compressor piston 50 travels upward, the air in the compressor cylinder 46 and above the compressor piston 50 is compressed. Because the top end of the drive cylinder 66 is in fluid communication with the compressor cylinder 46 via the associated vents 142, 110 in the plunger 122 and the end cap 98, respectively, the compressed air also acts upon the drive piston 70. The magnetic latch 144, however, holds or maintains the drive piston 70 in the top-dead-center position shown in FIG. 2B so long as the force of the compressed air acting on the drive piston 70 is less than the magnetic force acting on the drive piston 70 to maintain it in the top-dead-center position.

Figure 2D:
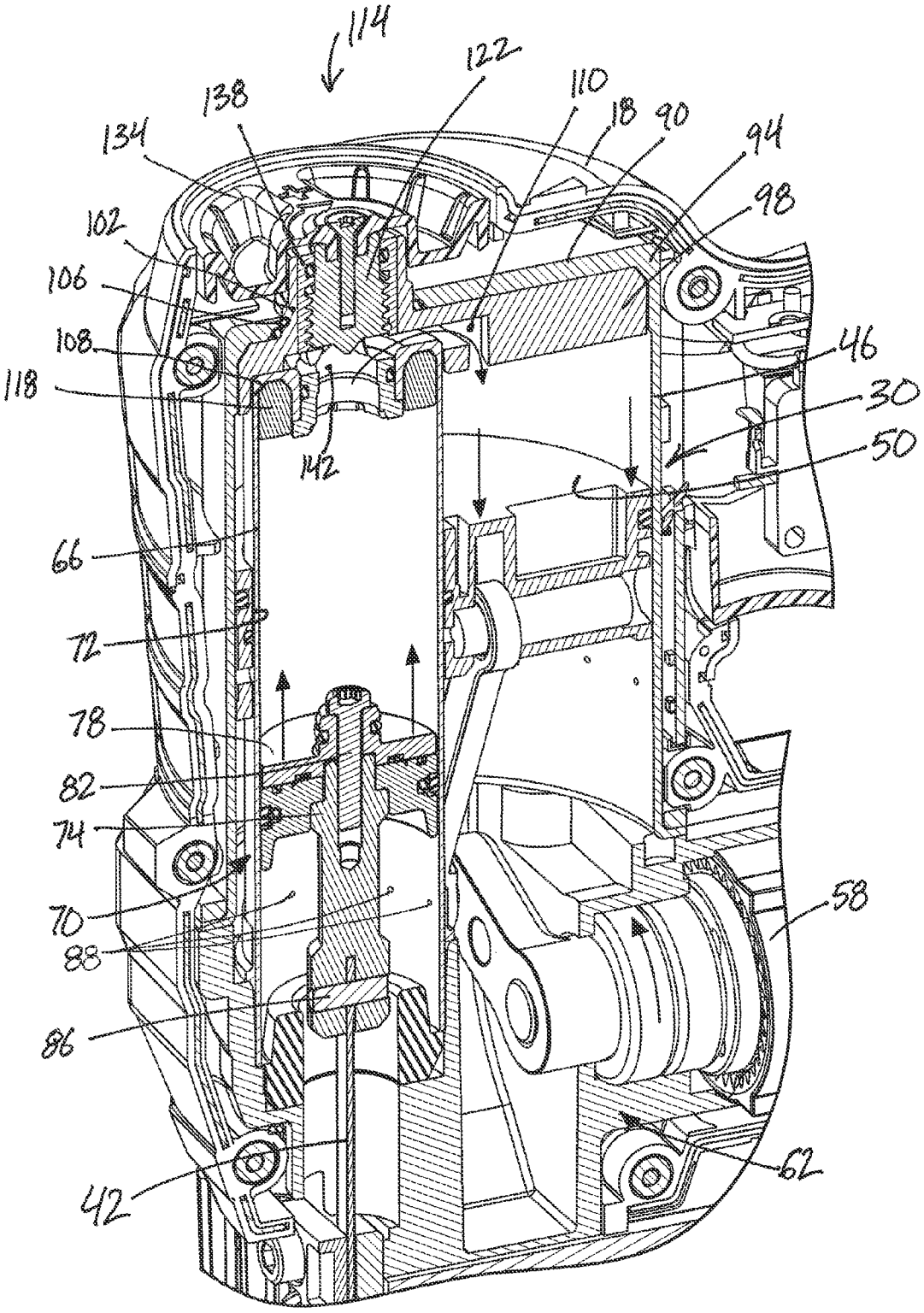
FIG. 2D is an enlarged, partial cross-sectional view of the pneumatic fastener driver of FIG. 2A illustrating an upward stroke of the driver piston.

As the compressor piston 50 approaches the top-dead-center position, the force of the compressed air acting on the drive piston 70 overcomes the magnetic force acting on the drive piston 70, and the drive piston 70 is accelerated downward within the drive cylinder 66 by the compressed air (FIG. 2C). As the drive piston 70 is driven downwards, the drive blade 42 impacts a fastener held in the magazine 14 and drives the fastener into a workpiece until the drive piston 70 reaches the bottom-dead-center position (shown in phantom in FIG. 2C). Upon the drive piston 70 reaching the bottom-dead-center position, any compressed air still acting on the drive piston 70 is vented from the drive cylinder 66 through the check valves 88. Finally, to prepare for a subsequent fastener driving operation, the compressor piston 50 is driven downwards towards the bottom-dead-center position by the motor 54 and crank arm assembly 62 (FIG. 2D). As the compressor piston 50 is driven downward, a vacuum is created within the compressor cylinder 46 and the drive cylinder 66, between the compressor piston 50 and the drive piston 70. The vacuum draws the drive piston 70 upwards in the drive cylinder 66 until the ferromagnetic cap 78 of the drive piston 70 abuts the plunger 122, after which time the magnetic latch 114 again holds or maintains the drive piston 70 in the top-dead-center position.

The magnetic latch 114 may be adjusted to vary the depth to which fasteners are driven into a workpiece. For example, to increase fastener driving depth, the actuator 134 is rotated in one direction to move the plunger 122 upward and toward a top end of the drive cylinder 66 to create a smaller gap 130 (FIG. 3B) between the magnet 118 and the ferromagnetic cap 78, increasing the magnetic force between the magnet 118 and the ferromagnetic cap 78. With the larger magnetic force, a larger compressed air force is needed to overcome the magnetic force and to release the drive piston 70. The larger compressed air force causes the drive piston 70, and subsequent drive blade 42, to drive the fastener deeper into the workpiece. Alternatively, to reduce the driving depth of the fastener, the actuator 134 is rotated in an opposite direction to move the plunger 122 downward and away from the top end of the drive cylinder 66 to create a larger gap 126 (FIG. 3A) between the magnet 118 and ferromagnetic cap 78, decreasing the magnetic force between the magnet 118 and the ferromagnetic cap 78. The lower magnetic force is overcome by a lower compressed air force, resulting in a reduced fastener driving depth.

Various features and advantages of the invention are set forth in the following claims.

What is claimed is:

1. A pneumatic fastener driver comprising:

a cylinder;

a piston positioned within the cylinder and moveable between a top-dead-center position and a bottom-dead-center position; and a magnetic latch emitting a magnetic field that magnetically attracts the piston and is capable of holding the piston in the top-dead-center position with a magnetic force, wherein the magnetic latch is adjustable to vary the magnetic force acting on the piston for driving fasteners into a workpiece at different depths;

wherein the magnetic latch includes a magnet emitting the magnetic field and a ferromagnetic portion of the piston, and wherein the magnetic latch includes a plunger movable between a first position in which a first gap is created between the ferromagnetic portion of the piston and the magnet resulting in a first magnetic force acting on the piston, and a second position in which a second gap smaller than the first gap is created between the ferromagnetic portion of the piston and the magnet resulting in a second magnetic force acting on the piston larger than the first magnetic force.

2. The pneumatic fastener driver of claim 1, wherein the magnet is annular.

3. The pneumatic fastener driver of claim 1, wherein the magnet is positioned adjacent a top end of the cylinder.

4. The pneumatic fastener driver of claim 1, wherein the magnetic latch includes an actuator operable to move the plunger between the first and second positions.

5. The pneumatic fastener driver of claim 4, wherein the plunger is threadably coupled to the cylinder, and wherein the actuator is rotatable for moving the plunger between the first and second positions.

6. The pneumatic fastener driver of claim 4, wherein the piston is displaced from the top-dead-center position to the bottom-dead-center position when the actuator is in the first position and when a force of compressed air acting on the piston exceeds the first magnetic force.

7. The pneumatic fastener driver of claim 4, wherein the piston is displaced from the top-dead-center position to the bottom-dead-center position when the actuator is in the second position and when a force of compressed air acting on the piston exceeds the second magnetic force.

8. The pneumatic fastener driver of claim 1, wherein the piston is a first piston and the cylinder is a first cylinder, and wherein the pneumatic fastener driver further includes a second cylinder at least partially surrounding the first cylinder and in fluid communication with the first cylinder, and a second piston positioned within the second cylinder and including a bore through which the first cylinder extends.

9. A pneumatic fastener driver comprising:

a first cylinder;

a first piston positioned within the first cylinder;

a second cylinder positioned within the first cylinder;

a second piston positioned within the second cylinder;

a cylinder head coupled to a first end of the first cylinder;

an end cap positioned within the first cylinder proximate the first end; and means for positioning the second cylinder relative to the first cylinder; wherein the means for positioning includes an opening formed in the cylinder head through which a stem portion of the end cap extends.

10. The pneumatic fastener driver of claim 9, wherein the means for positioning further includes a cylindrical recess formed in the end cap in which the second cylinder is at least partially received.

11. The pneumatic fastener driver of claim 10, wherein the end cap includes vents for fluidly communicating the first cylinder and the second cylinder.

12. The pneumatic fastener driver of claim 11, wherein the vents fluidly communicate the first cylinder and the second cylinder via the cylindrical recess.

13. The pneumatic fastener driver of claim 12, further comprising a plunger positioned within the stem portion of the end cap, wherein the plunger includes vents corresponding to the vents of the end cap for fluidly communicating the first cylinder and the second cylinder.

14. The pneumatic fastener driver of claim 9, wherein the cylinder head is integrally formed at the first end of the first cylinder as a single component.

15. The pneumatic fastener driver of claim 14, wherein the first cylinder and the cylinder head are manufactured using one of a deep-drawing process and an impact extrusion process.

16. The pneumatic fastener driver of claim 14, wherein the second cylinder extends through a bore of the first piston, and the second cylinder is in fluid communication with the first cylinder.

* * * * *